US009719474B2

(12) United States Patent
Sun et al.

(10) Patent No.: US 9,719,474 B2
(45) Date of Patent: Aug. 1, 2017

(54) DIRECT FUEL INJECTORS WITH VARIABLE INJECTION FLOW RATE

(71) Applicant: Regents of the University of Minnesota, Minneapolis, MN (US)

(72) Inventors: Zongxuan Sun, Plymouth, MN (US); Chienshin Wu, Minneapolis, MN (US)

(73) Assignee: Regents of the University of Minnesota, Minneapolis, MN (US)

( * ) Notice: Subject to any disclaimer, the term of this patent is extended or adjusted under 35 U.S.C. 154(b) by 249 days.

(21) Appl. No.: 14/758,882

(22) PCT Filed: Jan. 2, 2014

(86) PCT No.: PCT/US2014/010033
§ 371 (c)(1),
(2) Date: Jul. 1, 2015

(87) PCT Pub. No.: WO2014/107487
PCT Pub. Date: Jul. 10, 2014

(65) Prior Publication Data

US 2015/0337786 A1 Nov. 26, 2015

Related U.S. Application Data

(60) Provisional application No. 61/748,229, filed on Jan. 2, 2013.

(51) Int. Cl.
*F02M 47/02* (2006.01)
*F02M 63/00* (2006.01)
(Continued)

(52) U.S. Cl.
CPC ..... *F02M 63/0015* (2013.01); *F02M 45/12* (2013.01); *F02M 47/025* (2013.01);
(Continued)

(58) Field of Classification Search
CPC .. F02M 47/025; F02M 47/027; F02M 61/161; F02M 63/04; F02M 63/0029; F02M 2547/001; F02M 2547/008
(Continued)

(56) References Cited

U.S. PATENT DOCUMENTS 4,438,496 A 3/1984 Ohie
4,669,504 A 6/1987 Fujitsugu et al.
(Continued)

FOREIGN PATENT DOCUMENTS

EP 0775258 B1 1/2002
WO 2011/072293 A2 6/2011

OTHER PUBLICATIONS

T. Johnson "Diesel Emission Control in Review," SAE 2006-01-0030, downloaded from SAE International on Jun. 17, 2015, 18 pages.

(Continued)

*Primary Examiner* — Erick Solis
(74) *Attorney, Agent, or Firm* — Kagan Binder, PLLC

(57) ABSTRACT

An injector is designed to provide continuously variable injection rate shaping. With a hydro-mechanical internal feedback mechanism, injector needle position can be determined by controlling a feedback valve's on/off timing. According to the needle position, an injection needle valve opening can be controlled, and then the injection flow rate can be delivered proportionally. Also in accordance with the present invention a CRDI systems are provided including injectors of the present invention, wherein results demonstrate that injector designs of the present invention not only achieve rate shaping capability but also solve the above-noted problems of the current CRDI system. Finally, an iterative learning controller has also been developed to track
(Continued)

the desired injection rate, and an injection rate estimator is designed to realize a cycle to cycle feedback control.

22 Claims, 5 Drawing Sheets

(51) Int. Cl.
*F02M 63/02* (2006.01)
*F02M 61/16* (2006.01)
*F02M 61/10* (2006.01)
*F02M 45/12* (2006.01)

(52) U.S. Cl.
CPC ..... *F02M 47/027* (2013.01); *F02M 61/10* (2013.01); *F02M 61/161* (2013.01); *F02M 63/0068* (2013.01); *F02M 63/0275* (2013.01); *F02M 2547/001* (2013.01); *F02M 2547/008* (2013.01)

(58) Field of Classification Search
USPC ..... 123/447, 456
See application file for complete search history.

(56) References Cited

U.S. PATENT DOCUMENTS

| | | | | |
|---|---|---|---|---|
| 5,697,342 | A | 12/1997 | Anderson et al. | |
| 5,860,597 | A | 1/1999 | Tarr | |
| 6,837,221 | B2 | 1/2005 | Crofts et al. | |
| 6,912,998 | B1 | 7/2005 | Rauznitz et al. | |
| 6,978,770 | B2 | 12/2005 | Rauznitz et al. | |
| 7,111,614 | B1 | 9/2006 | Coldren et al. | |
| 7,275,522 | B2 | 10/2007 | Beilharz et al. | |
| 2003/0106533 | A1 | 6/2003 | Crofts et al. | |
| 2005/0034708 | A1 | 2/2005 | Augustin | |
| 2009/0114744 | A1* | 5/2009 | Bernhaupt | F02M 45/04 239/584 |
| 2012/0152206 | A1* | 6/2012 | Adachi | F02M 47/027 123/445 |

OTHER PUBLICATIONS

B. Mahr, "Future and Potential of Diesel Injection Systems", 2002 Conference on Thermo and Fluid Dynamic Processes in Diesel Engines, 13 pages.

S. Kohketsu et al., "Flexibly Controlled Injection Rate Shape with Next Generation Common Rail System for Heavy Duty D1 Diesel Engines", SAE 2000-01-0705, downloaded from SAE International on Jun. 17, 2015, 12 pages.

T. Hasegawa et al., "Study on the Fuel Spray and Combustion of the Variable Orifice Nozzle (VON) for Direct Injection Diesel Engines", SAE 200-01-0941, downloaded from SAE International on Jun. 17, 2015, 12 pages.

A. Matsumoto, "Characterization of Diesel Common Rail Spray Behavior for Single- and Double-Hole Nozzles", SAE 2008-01-2424, downloaded from SAE International on Jun. 17, 2015, 13 pages.

A. Catania et al., "Experimental Investigation of Dynamics Effects on Multiple-Injection Common Rail System Performance", J. Eng. Gas Turbines Power, vol. 130, Issue 3, Mar. 28, 2006, May 2008, 13 pages.

X. Ding et al., "Research Into Pressure Wave Correction of Fuel Quantity Fluctuation for CRS with Piezo Actuated Injector", Transactions of Beijing Institute of Technology, 2010, 6 pages.

Herrmann et al., "The Breakthrough of Common Rail System: Closed-Loop Control Strategy Using an Injector With Built-In Pressure Sensor", Denso Germany, 2009, 17 pages.

Boggavarapu et al., "Computational Study of Injection Rate-Shaping for Emissions Control in Diesel Engines," SAE 2011-26-0081, published on Jan. 19-21, 2011 SIAT, India, 13 pages.

Heinzen et al., "Iterative Learning Control of a Fully Flexible Valve Actuation System for Non-Throttled Engine Load Control," Control Engineering Practice, vol. 19, Issue 12, pp. 1490-1505, Dec. 2011.

Sun, "Electrohydraulic Fully Flexible Valve Actuation System with Internal Feedback", Journal of Dynamic Systems, Measurement, and Control, Mar. 2009, vol. 131, 8 pages.

Catania et al., "Development and Application of a Complete Multijet Common-Rail Injection-System Mathematical Model for Hydrodynamic Analysis and Diagnostics," Journal of Engineering for Gas Turbines and Power, vol. 130, Nov. 2008, 13 pages.

Boudy et al., "Impact of Physical Properties of Biodiesel on the Injection Process in a Common-Rail Direct Injection System," Energy Conversion and Management, vol. 50, Issue 12, Dec. 2009, pp. 2905-2912.

Bright et al., "Possible Very High Speed Rate Shaping Fuel Injector," SAE 2007-01-4113, downloaded from SAE International Jun. 17, 2015, 9 pages.

Thein et al., "Comparison of the Sliding Observer to Several State Estimators Using a Rotational Inverted Pendulum," Proceedings of the 34th Conference on Decision & Control, New Orleans, LA, vol. 4, p. 3385-3390, Dec. 1995.

* cited by examiner

DIRECT FUEL INJECTORS WITH VARIABLE INJECTION FLOW RATE

CROSS-REFERENCE TO RELATED APPLICATIONS

This application claims priority to International Application No. PCT/US2014/010033, filed Jan. 2, 2014, which in turn claims the benefit under 35 USC §119(e) of U.S. Provisional Patent Application No. 61/748,229, filed Jan. 2, 2013 and titled "DIRECT FUEL INJECTORS WITH VARIABLE INJECTION FLOW RATE" both of which are incorporated herein by reference in their entireties.

FIELD OF THE INVENTION

The present invention is directed to direct fuel injection systems and injectors with injection rate shaping control. More particularly, direct fuel injectors of the present invention utilize a common rail for fuel supply and the shaping control is accomplished by variation of the injection nozzle orifice area.

BACKGROUND OF THE INVENTION

Due to the rising awareness of the global environmental concerns in recent decades, the emission control and fuel consumption have become two key issues in the contemporary automobile industry. By directly delivering the fuel into the engine combustion chamber with accurate quantity and flexible timing, the direct injection (DI) system is one of the most promising technologies to cope with the emission problems without sacrificing the engine performance. Among the available DI systems in the current market, the common rail direct injection (CRDI) system is the most popular one. The injection rate shaping control refers to the method for determining the fuel injection flow rate as a function of time, and is critical for the CRDI system performance.

The current injection rate shaping control can be generally classified into three categories: (i) multiple-injection, (ii) injection pressure variation, and (iii) injection nozzle orifice area variation. The working principle of each category is discussed below. Designs of the present invention shape injection flow rate by controlling an injector needle valve opening and is considered to fall within the methods of category (iii), methods of injection nozzle orifice variation.

Multiple-injection is currently the most common injection rate shaping control method in the CRDI system. The conventional injector is designed to function as an on/off valve, and as such, shapes the rate by a pulse-width-modulation method. The actuation period of the injector control valve is controlled to divide one injection cycle into several discrete injection shots for approximating continuous rate shaping. For a finer approximation, the injection shots per cycle increases. This requires a high bandwidth actuator for the injector, which increases the cost. Moreover, these discrete injection shots induce the pressure vibration in the hydraulic circuit of the CRDI system, which influences the precision of the following injection timing control. This causes inconsistencies of the injection quantity.

In order to solve this problem, several methods have been proposed. An open-loop control method has been developed to establish an injection map by means of injection quantity calibration. By doing a multiple-injection experiment several times, the periodic injection quantity variation can be verified, and the energizing time of the injector actuator can be adjusted to achieve the desired injection quantity. However, as the number of injections per cycle increases, the calibration load becomes extremely heavy. Moreover, even if the injection quantity can be compensated, the injection flow rate will not be the same anymore. Besides the off-line calibration methods, efforts have also been made including feedback control steps. For example, a feedback close-loop control has been developed including an additional pressure sensor provided near an injector upper chamber. This method eliminates the considerable calibration load but still compensates for the injection quantity by adjusting the energizing time.

The injection pressure variation method, as the name implies, controls the fuel injection rate by changing the injection pressure. One way to vary the injection pressure is to apply a pressure intensifier on the injector. Because of the high injection pressure and the extremely short injection window, an additional large power source is required for this system to boost the injection rate. Another way is called a dual common rail system. The pressurized fuel is stored in different reservoirs with different working pressures. In the low-pressure common rail, the pressure is typically around 200-400 bar, and the pressure is about 1200 bar in the high-pressure common rail. A switching valve is provided in order to control the supply fuel pressure from these two common rails to the injector, and then the injection rate changes due to different injection pressures. Besides requiring an additional high pressure reservoir, this method provides only a two-step injection rate shaping.

The injection nozzle orifice area variation method basically controls the injection rate by opening the nozzle orifice area proportionally. In a known system, a rotary valve is controlled by a stepper motor to continuously change the injection nozzle orifice area. The change rate of the nozzle area depends on how fast the stepper motor can respond, which indicates a high requirement for the motor. Another known design is called a two-stage nozzle. Equipped with two groups of injector nozzles and two injector needles, this method realizes a two-step injection rate shaping, but the flexibility of the rate shaping is limited.

Another contemplated method to control the nozzle opening proportion is called direct actuated injector control. The injector actuator as fabricated by specific materials controls the needle lift directly to give proportional needle valve opening. This technology is still under development and also requires a real-time feedback control for the needle displacement. However, the real-time feedback control is difficult to realize because of two barriers. Firstly, due to the lack of adequate sensors, the injector needle position and the injection flow rate are undetectable. Secondly, the CRDI system is nonlinear, which makes the state observer design difficult.

BRIEF SUMMARY OF THE INVENTION

According to the present invention, a novel injector is designed to provide continuously variable injection rate shaping. With a hydro-mechanical internal feedback mechanism, injector needle position can be determined by controlling a feedback valve's on/off timing. According to the needle position, an injection needle valve opening can be controlled, and then the injection flow rate can be delivered proportionally. Also in accordance with the present invention a CRDI systems are provided including injectors of the present invention, wherein results demonstrate that injector designs of the present invention not only achieve rate shaping capability but also solve the above-noted problems of the current CRDI system. Finally, an iterative learning controller has also been developed to track the desired injection rate, and an injection rate estimator is designed to realize a cycle to cycle feedback control.

In a first aspect of the present invention, a fuel injector is provided for use within a direct injection fuel injection system having a common rail for supplying fuel at a determined delivery pressure, wherein the fuel injector comprises an injector needle slidably disposed within a housing, the injector needle and the housing together providing a control chamber wherein the control chamber is fluidly connected with both a first control orifice within a connection with pressurized fuel from the common rail and a second control orifice within a connection with a drain line so that fluid pressure can be regulated within the control chamber by way of control of fluid flow through the first and second control orifices, a delivery chamber including a port for connection with the pressurized fuel from the common rail and an injection orifice from which fuel can be injected upon movement of the injector needle, and a feedback chamber being in fluid communication with at least one internal feedback spool valve that can be actuated by increased pressure within the feedback chamber to close the first and second control orifices of the control chamber based upon movement of the injector needle.

In another aspect of the present invention, a direct fuel injection system is provided for connection with a common rail for supplying fuel at a determined delivery pressure, the fuel injection system comprising a fuel injector including an injector needle slidably disposed within a housing, the injector needle and the housing together providing a control chamber wherein the control chamber is fluidly connected with both a first control orifice within a connection with pressurized fuel from the common rail and a second control orifice within a connection with a drain line so that fluid pressure can be regulated within the control chamber by way of control of fluid flow through the first and second control orifices, a delivery chamber including a port for connection with the pressurized fuel from the common rail and an injection orifice from which fuel can be injected upon movement of the injector needle, and a feedback chamber being in fluid communication with at least one internal feedback spool valve that can be actuated by increased pressure within the feedback chamber to close the first and second control orifices of the control chamber based upon movement of the injector needle; a control valve fluidly within the drain line from the control chamber capable of selectively opening and closing the drain line to regulate fluid pressure within the control chamber; a feedback valve provided within a fluid line connected with the feedback chamber capable of selectively opening and closing the fluid line from the feedback chamber and for selectively controlling activation of the at least one internal feedback spool valve; and a control module for selectively activating the control valve and the feedback valve during a fuel injection cycle, wherein the control valve and the feedback valve can be varied on a cycle-by-cycle basis.

In another aspect of the present invention, a method of flow rate estimation and iterative learning control is determined for timing of activation of a control valve and a feed back valve so that the feedback valve can be controlled and adjusted on a cycle by cycle basis in order to achieve a desired fuel flow rates from an injector of a direct fuel injection system, the injector comprising an injector needle slidably disposed within a housing, the injector needle and the housing together providing a control chamber wherein the control chamber is fluidly connected with both a first control orifice within a connection with pressurized fuel from the common rail and a second control orifice within a connection with a drain line so that fluid pressure can be regulated within the control chamber by way of control of fluid flow through the first and second control orifices, a delivery chamber including a port for connection with the pressurized fuel from the common rail and an injection orifice from which fuel can be injected upon movement of the injector needle, and a feedback chamber being in fluid communication with at least one internal feedback spool valve that can be actuated by increased pressure within the feedback chamber to close the first and second control orifices of the control chamber based upon movement of the injector needle, the method comprising the steps of estimating the flow rate of the injector based on measurement of the common rail pressure, the activation timing of the control valve and the activation timing of the feedback valve; and iteratively controlling the period between activation timing of the control valve and the feedback valve on an injection cycle by cycle basis by way of an iterative learning control of a control module that is electronically connected with the control valve and the feedback valve for controlled activation of the control valve and the feedback valve.

BRIEF DESCRIPTION OF THE SEVERAL VIEWS OF THE DRAWINGS

Other important objects and advantages of the present invention will be apparent from the following detailed description of the invention taken in connection with the accompanying drawings in which.

DETAILED DESCRIPTION OF THE INVENTION

The present invention is directed to injectors with an injection rate shaping control system and as well as to methods of controlling injection rate shape. As mentioned in the Background section, injection rate shaping control methods, such as the multiple-injection, the variable injection pressure, or the variable injection nozzle area, are each associated with certain limitations and drawbacks that can deteriorate the performance or feasibility. The present invention is directed, in particular, to improved control systems and methods as applied to a CRDI system to flexibly control the injection rate.

Figure 1:
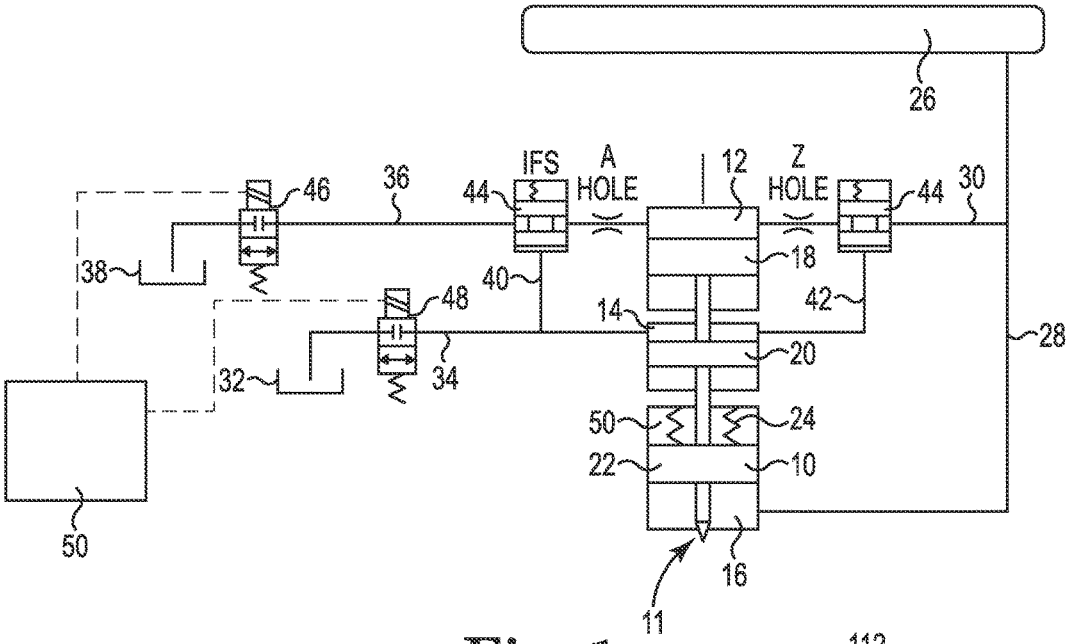
FIG. 1 is a schematic illustration of a DI injection system of the present invention including a feedback circuit in accordance with the present invention.

For typical injection strategies, a desired injection rate shaping is often graphically illustrated as a trapezoid. The injection usually starts with a smaller fuel injection rate and then increases to the full rate. Hence, one way to shape the injection rate is by means of an injector needle valve opening control mechanism. By applying a hydro-mechanical internal feedback mechanism, a tapered injector needle displacement can be controlled. This allows the continuous variation of the injector needle valve opening. Modified from the original DI injector design, the new injector design concept with the internal feedback mechanism is schematically shown in FIG. 1, and the working principle is explained as follows. Injection control according to the present invention allows for a variable flow rate control on a cycle-by-cycle basis. Only a single injection is required per cycle where the flow rate is varied and shaped continuously by changing the orifice opening per injection based upon the degree of controlled displacement of an injector needle 10, which is tapered and positioned relative to a fixed injection orifice 11.

As schematically illustrated within FIG. 1, the injector needle 10 is movable within an injection chamber, which is shown as comprising a control chamber 12, a feedback chamber 14, and a delivery chamber 16. The injector needle 10 itself is shown as comprising multiple large and small diameter sections for functionally creating a control chamber plunger 18, a feedback chamber plunger 20, and a delivery chamber plunger 22. A biasing means, such as a compression spring 24 is shown for biasing the delivery chamber plunger 22 and thus the entire injector needle 10 toward a closed position, for effectively closing the injector orifice 11, subject to fluid pressures within each of the chamber portions, as described in more detail below.

A common rail 26 is provided as a fuel supply at a desired operating pressure. The design and provision of such common rails is well known, as is the operating pressures that are desired to be maintained within such a common rail depending of the type of fuel, for example, whether supplying gasoline or diesel fuel. The provision of fuel supply to the common rail at a desired pressure is also conventionally known.

From the common rail 26, a connecting pipe 28 runs to the delivery chamber 16 so that fuel can be supplied at the desired injection pressure into the delivery chamber 16 prior to injection. Branching from the connecting pipe 28, a pipe 30 also supplies the same pressurized fuel to the control chamber 12. The common rail 26, connecting pipe 28 and branch pipe 30 comprise a high-pressure system of an embodiment of an injection control system of the present invention.

A low pressure system of the illustrated system of the present invention comprises a low pressure reservoir 32 that can be at a pressure as low as atmospheric, but preferably is controlled to be higher than atmospheric and potentially as high a pressure as up to the same pressure as the high pressure side within the common rail 26. Within the low pressure side, a first connecting pipe 34 provides fluid communication from the reservoir 32 to the feedback chamber 14. In a different branch of the low pressure side, a second connecting pipe 36 provides fluid communication from the control chamber 12 to a low-pressure tank 38 that would be provided at a lower pressure than the high-pressure side, preferably at atmospheric pressure.

Also as part of the low-pressure side, a feedback circuit can control the degree of movement of the injector needle 10 away from the injector orifice 11, as will be described below. This feedback circuit is shown as comprising a fluid connection pipe 40 from the pipe 34 to a first internal feedback spool valve 44 (IFS) while another fluid connection pipe 42 provides fluid connection from the feedback chamber 14 to a second internal feedback spool valve 44. Additionally, the control chamber 12 is fluidly connected with the first internal feedback spool 44 on the low-pressure system side by way of an opening or first control port that is also referred to as an A-hole. The second internal feedback spool 44 is connected on the high-pressure system side between the connection pipe 30, and thus ultimately the common rail 26, and the control chamber 12. An opening or second control port that is also referred as the Z-hole allows fluid flow between the control chamber 12 and the second internal feedback spool 44. Each of the IFSs 44 are preferably biased toward an open position allowing fluid flow through them.

A control valve 46 is illustrated within the connection pipe 36 between the first IFS 44 and the tank 38. The control valve 46 can comprise an on/off solenoid valve that is preferably normally biased to a closed position, which would prevent flow from the control chamber 12, through the A-hole, though the first IFS 44 and further through the connecting pipe 36 to the tank 38. At this point it can be seen that high pressure fuel as supplied by the common rail 26 would flow through the second IFS 44, the Z-hole, the control chamber 12, the A-hole, the first IFS 44 and the connecting pipe 36 to the tank 38 when the control valve is activated to an open state and each of the IFSs 44 remain open. In effect, the flow through the A and Z-holes as controllably allowed by opening the control valve 46 allows the pressure within the control chamber 12 to be reduced relative to the pressure within the delivery chamber, as both are supplied pressurized fuel from the common rail 26.

Also shown in FIG. 1 is a feedback valve 48 that selectively fluidly connects the low-pressure reservoir with the feedback chamber, which feedback valve 48 can also comprise an on/off solenoid type valve. Contrary to the operation of the control valve 46, the feedback valve 48 is preferably open when it is deactivated. However, when the feedback valve 48 is activated to be closed, fluid communication between the feedback chamber 14 and the low-pressure reservoir 32 is prevented while fluid pressure can build within the feedback chamber 14 so that the increased fluid pressure will act to shift the first and second IFSs 44 toward closing positions each by way of fluid lines 34, 40 and 42.

With the feedback valve 48 in its normal open position, the injector system can basically operate as a conventional direct injection system. Any pressurized fluid present or created by upward injector needle movement within the feedback chamber 14 will flow through the feedback valve 48 toward the low-pressure reservoir 32 without creating sufficient pressure to move either IFS 44 against its normal bias position allowing fluid flow through it. Thus, the high pressure system side will operate normally based upon the position of the control valve 46. Specifically with the control valve 46 closed, equal fluid pressure from the common rail 26 will be provided to both the control chamber 12 and the delivery chamber 16. With the bias of spring 24, the injector 10 will remain closed with the injector needle seated to the injector orifice 11. With the control valve 46 shifted to open, lower pressure within the control chamber 12, as allowed by the fluid flow through both the A and Z-holes, will eventually allow the pressure within the delivery chamber 16 to dominate the system against the bias of spring 24 to unseat the injector needle from the injector orifice 11 and thus open the orifice 11 for fuel delivery. The injector orifice 11 will open to the preset delivery position of the injector needle away from the orifice 11. The present invention is directed to techniques for varying this process on a cycle-by-cycle basis for varying fuel injection rate for each cycle.

For injector operation according to the schematic of FIG. 1, the control valve 46 can be energized and opened so that high-pressure fluid in the control chamber 12, as supplied from the common rail 26 via the second IFS 44 and the Z-hole, flows out to the tank 38 by way of the first IFS 44 and the A-hole, to create the lower pressure within the control chamber 12. Thus, the injector needle 10 starts to move upward due to the higher pressure of the fuel as supplied to the closed delivery chamber 16. As such, when the feedback valve 48 is open, the injector system of FIG. 1 works as a conventional injector system.

On the controlled occurrence (preferably at least once for each injector delivery cycle) that the feedback valve 48 is activated and closed, the plunger portion 20 of the injector needle 10 will gradually reduce the feedback chamber volume and increase the pressure of the fluid in the feedback chamber 14. As the fluid pressure force acting on the IFS spools 44 exceeds the spring preload for each IFS 44, the IFSs 44 move upward to gradually close the A and Z holes. Through this hydro-mechanical internal feedback mechanism, the closing speed of these two control holes (the A and Z holes) is synchronous with injector needle displacement. Fuel flow into and out of the control chamber 12 can thereby be controllably restricted. Meanwhile, the needle upward motion raises the control chamber pressure 12. The increasing fluid pressure force in the control chamber 12 acting on the plunger portion 18 of the injector needle 10 will gradually decelerate the needle 10 to stop at a predetermined destination. By this design, the needle lift is determined robustly after the feedback valve 48 activation.

As the injector needle 10 stops moving as controllably limited by activation of the feedback valve 48, the tapered needle valve 10 is only opened partially from the injector orifice so as to control a less than full injection flow rate from the delivery chamber 16 to an engine combustion chamber. Advantageously, the flow rate can be varied from cycle to cycle based upon activation timing of the feedback valve 48. When a full rate is subsequently desired, the feedback valve 48 can be deactivated after first achieving a partial-point stop and re-opened to allow draining of the fluid in the feedback chamber 14 to the low pressure reservoir 32. At this point also, the feedback chamber 14 begins to reassume a lower pressure condition. Then, the IFSs 44 will be gradually released to their initial open positions to gradually reopen the A and Z control holes. The needle 10 would then be influenced again based upon the open control valve 46 (the flow of high pressure fluid through both the A and Z holes) to reduce the pressure within the control chamber 12 and thus to fully open the needle valve 10.

By adjusting the IFSs 44 activation timing (the feedback valve closing timing), the injector needle 10 can be stopped at any assigned position within its full stroke. This provides the capability to shape the injection rate continuously. For example, at the partial lift position as defined by closing the feedback valve 48 at a desired time, fuel will flow from the injector orifice 11 as controlled by the position of the tapered surface of the injector needle 10 to the injection orifice 11. This can occur for a determined time. Then by deactivating the feedback valve 48 after the determined period while the control valve 46 is still activated, the fuel flow rate can be controllably increased to a full flow rate by the change in orifice area that is opened by further movement of the injector needle 10 away from the injection orifice 11. Again, this full flow rate injection period can be determined as well. It is also contemplated that there could be more than one partial-point stops during a single injection cycle. In any case, timing of the activations and deactivations of the feedback valve 48 along with the timing of activation and deactivation of the control valve 46 can be controllably changed on a cycle-by-cycle basis under the control of an electronic control module 50. A control module 50 is schematically illustrated as electronically connected with both the control valve 46 and the feedback valve 48 via the dashed connection lines in FIG. 1. It is understood that the control module 50 can be conventionally provided with control circuitry to control the activation and deactivation timing of both the control valve 46 and the feedback valve 48, based upon the known ability to control a control valve under known DI control systems. Similar timing control circuitry can be used for each of the activation and deactivation steps of both valves. Control modules usable in accordance with the present invention are well known and commercially available. In accordance with the present invention, controlled programming of the feedback circuit and thus valve activation can be done in the same manner as a conventional control valve of prior art systems are controllable activated.

The operation time scale for a DI injector is typically only a few milliseconds, the assembly space is usually within 2 centimeters diameter circle, and the needle stroke is only around 0.2 to 0.4 millimeters. These parameters lead to more considerations for designing a feedback circuit and also feedback spool(s) and the A and Z control orifices.

In the above embodiment, a feedback circuit includes the feedback chamber 14, the feedback fluid connections 40 and 42, the IFSs 44 and the feedback on/off control valve 48. This feedback circuit is an example of key fundamental functionality to systems and methods of the present invention in that a stroke of an injector needle 10 can be stopped at any intermediate position by closing the A and Z holes. As such, injector needle 10 displacement is controlled as the injector needle 10 moves from its seated position closing the injection orifice 11 by fluid pressure balances that are caused when the control valve 46 is open so that high pressure fuel is supplied to both the delivery chamber 16 and the control chamber 12. The closing of the A and Z holes happens as a result of the increase of the feedback chamber 14 pressure when the feedback valve 48 is activated to be closed. Such action causes movement of the IFSs 44 to gradually close the A and Z holes. Dynamically, the act of gradually closing the A and Z holes causes an increase in the control chamber 12 pressure while fuel is injected from the delivery chamber 16, which also dynamically affects the stroke movement rate and fuel delivery rate. This happens until the A and Z holes gradually close completely. After the A and Z holes are fully closed, the injector needle 10 can move completely to its mechanical stop by opening the feedback valve 48 while the control valve 46 is activated to its open position. Basically, at this point, the injector would operate like a conventional DI injector.

Nonetheless, the limited assembly space within DI injectors increases the difficulty for adding a feedback circuit within the injector space. Therefore, the present invention is also directed to designs to simplify the feedback circuit assembly while allowing for similar rate shaping performance.

Figure 2:
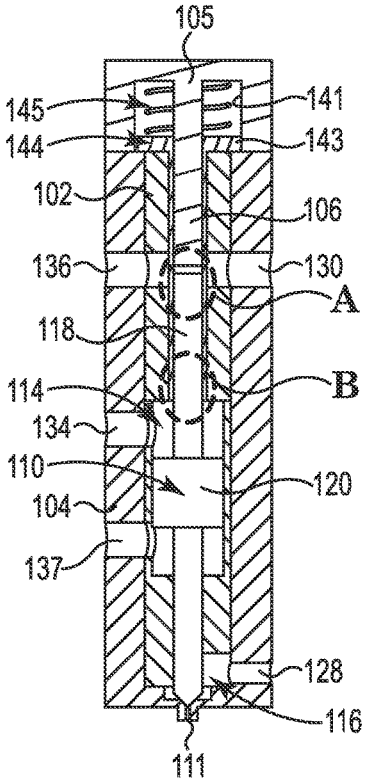
FIG. 2 is a cross sectional view of an injector design in accordance with the present invention that can be utilized in the system of FIG. 1 and having a concentric sleeve as and internal feedback spool in accordance with the present invention.

Comparing a prior art injector design to that in FIG. 1, an inventive design contains an additional feedback chamber 14. In FIG. 1, since pressure force in the feedback chamber 14 acts downward, needle return preload can be replaced or supplemented by this force. As such, for example, needle spring assembly space can be used as a feedback chamber 14. FIG. 2 shows another embodiment of an injector in accordance with the present invention along with a control system of the present invention wherein the IFSs 44 of the FIG. 1 embodiment is designed as a sleeve 144 that slides on an injector needle 110 and that is connected to a feedback chamber 114 directly. Components similar to those of the schematic of FIG. 1 are labeled with a similar number but preceded by a 1 as the hundred digit. In accordance with this design, the feedback fluid channels 40 and 42 can be removed to avoid more complicated fabrication.

In this embodiment, the injector needle 110 is provided within a chamber defined within an inner housing 102, which itself is preferably provided within a bore of an outer injector housing 104. This construction allows chambers, as described below, to be formed within the inner housing 102 while fluid ports, also described below, are formed through the outer housing 104. A cap element 105 is preferably provided to close off the top end of the housings 102 and 104 and also preferably includes a center post 106 that extends into the central bore of the inner housing 102 for reasons described below.

The injector of this embodiment includes a high pressure side and a low pressure side similar to that described above with respect to FIG. 1. Also, a feedback control circuit is preferably provided similar to FIG. 1, but with a variation in that the two IFS valves 44 are replaced by a single IFS sleeve 144 that controllable shifts within the construction of this embodiment to open and close A and Z holes simultaneously from a single IFS sleeve 144. The construction of this embodiment illustrates the functionality of that described in FIG. 1 with all of the functional components compacted within an injector size assembly. The high and low pressure fuel lines and the electrical control lines are not illustrated in FIGS. 2-5 with the understanding that these systems can be similar to those described above.

Figure 3:
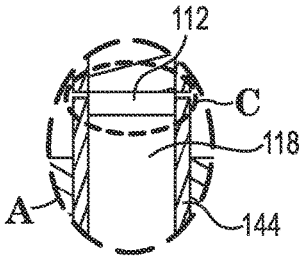
FIG. 3 is an enlarged view of a portion of the injector of FIG. 2 of the area within dashed oval A illustrating an internal feedback spool as a concentric sleeve with control holes relative to a control chamber in accordance with the present invention.
Figure 4:
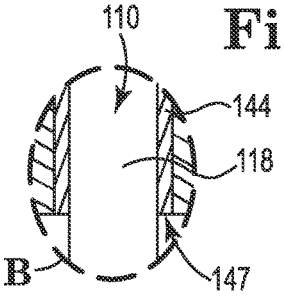
FIG. 4 is an enlarged view of a portion of the injector of FIG. 2 of the area within dashed oval B illustrating a control surface of an internal feedback spool as a concentric sleeve relative to a feedback chamber in accordance with the present invention.
Figure 5:
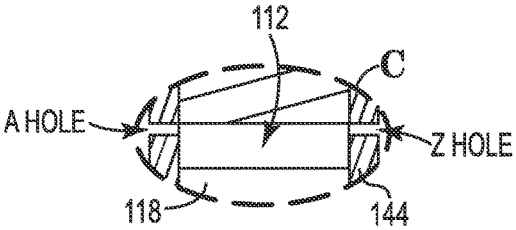
FIG. 5 is an enlarged view of a portion of the injector of FIG. 2 of the area within dashed oval C as shown in FIG. 3 and illustrating an upper surface of an internal feedback spool as a concentric sleeve with control holes relative to a control chamber in accordance with the present invention.

Like the FIG. 1 embodiment, a control chamber 112 is provided as best shown in FIGS. 3 and 5. The control chamber 112 comprises a portion of the bore of the inner housing 102 and a plunger portion 118 of the injector needle 110 moves within the control chamber 112 similar to that described above. The top of the control chamber 112 is closed off by a surface of the central post 106 that is provided in a fixed position with the housings 102 and 104. As shown in FIG. 5, A and Z holes are provided to allow for the controlled flow of high pressure fuel through the control chamber 112 similar to that described above. The A and Z holes are provided in diametrically opposed relationship, for example, as shown but need not be. Controlled simultaneous opening and closing of the A and Z holes is controlled by the IFS sleeve 144, as described below. High pressure fuel is provided to the Z hole and thus the control chamber 112 by way of a port 130 of the outer housing 104 and can flow from control chamber 112 by way of the A hole and port 136.

A delivery chamber 116 is illustrated as formed by a lower portion of the inner housing 102 and a lower portion of the outer housing that is provided with a fuel supply port 128. High pressure fuel enters the delivery chamber 116 via the port 128 and can exit the delivery chamber 116 through the injector orifice 111 when the tapered portion of the injector needle 110 is moved from its seat with the injector orifice. High pressure fuel within the delivery chamber 116 can cause the opening of the injector orifice 111 as the high pressure acts on the tapered portion of the injector needle 110 based upon the controlled flow of high pressure fuel through the control chamber 112, as controlled by flow through the A and Z holes, and as permitted by activation of a control valve 46, as described above. A feedback chamber plunger 120 is preferably provided as part of the injector needle 110 and moves within a feedback chamber 114 formed within the inner housing 102 and that allows fluid flow into the feedback chamber 114 by way of a port 134 as permitted by the feedback valve 48 when in its biased open position allowing fluid flow through the feedback valve 48. As above, when the feedback valve 48 is activated to a closed position, while the control valve 46 is activated open, fluid pressure can build within the feedback chamber 114 by upward movement of the injector needle 110 and in particular the feedback plunger 120 within the feedback chamber 114. A port 137 is also illustrated below the plunger 120 allowing leakage flow from the feedback chamber 114 to the low pressure tank 38.

The IFS sleeve 144, in this illustrated embodiment, is slidably positioned within the central bore of the inner housing 102 and is also slidably disposed on the upper portion 118 of the injector needle 110 and the central post 106 of the cap 105. A flange 143 is provided at the top of the IFS sleeve 144 and is positioned within a recess 141 of the cap 105 to also be slidable within the recess 141. A spring 145 biases the IFS sleeve 144 downward so as to position the flange 143 against a top surface of the inner housing 102. In this biased position, an IFS control surface 147 is preferably positioned even with a surface of the inner housing. 102 that defines the top of the feedback chamber 114, as best illustrated within FIG. 4. The IFS control surface 147 of the IFS sleeve 144 is affected by the pressure within the feedback chamber to cause the IFS sleeve to move upwardly relative to the inner housing, the portion 118 of the injector and the central post 106, such as when the feedback valve 48 is activated to be closed while the control valve 46 is activated open and the injector needle 110 is caused to move upward, as described above. The A and Z holes are preferably provided in diametrically opposed relationship by control openings through the IFS sleeve 144, as best shown in FIG. 5. Upward movement of the IFS sleeve 144 against the bias of the spring 145 relative to the central post 106, from the position shown in FIG. 5 will simultaneously close the A and Z holes. The A and Z holes can otherwise be positioned at different axial spaced levels of the IFS sleeve 144 provided that the central post 106 is modified is a corresponding manner. For example, if the A hole is axially higher as shown in FIG. 5 than the Z hole, the central post would be modified to have its closing surface higher on the left side (as viewed in FIG. 5) by a corresponding amount. An advantage of such a design is that the fluid path between the A and Z holes can be lengthened, which decreases any leakage between the A and Z holes when the A and Z holes are closed by the central post 106.

The functionality of the embodiment of FIGS. 2-5 is substantially similar to that described above with respect to FIG. 1. However, instead of causing movement of the two IFS valves 44 to independently close the A and Z holes simultaneously, movement of the IFS sleeve 144 can assure simultaneous closing and opening of the A and Z holes.

Like in the operation described above with respect to FIG. 1, increased fluid pressure within the feedback chamber 114 exerts a force on the IFS surface 147, which causes movement of the sleeve 144 along the upper portion 118 of the injector and the central post 106. The control chamber 112 and the delivery chamber 116 act in the same manner as described above with respect to the schematic of FIG. 1.

With the spring 145, the IFS 144 mass and the feedback chamber 114, the internal feedback mechanism is considered as a third-order dynamic system. The system parameters are preferably designed to avoid operating the IFS at the range of the system resonance mode.

In FIG. 1, there are two IFS valves 44 to close both the orifices of the injector control chamber 12. The two IFSs 44 should preferably close the two control orifices, the A and Z holes, simultaneously, as described above. However, the operation time for the injection is only a few milliseconds and is even shorter during an IFS activation. As a result, the synchronization of the two IFSs activation could be difficult to ensure. By designing the IFS as a concentric sleeve 144, not only are the number of parts reduced, it is also guaranteed that the A and Z holes will be closed simultaneously.

Figure 6:
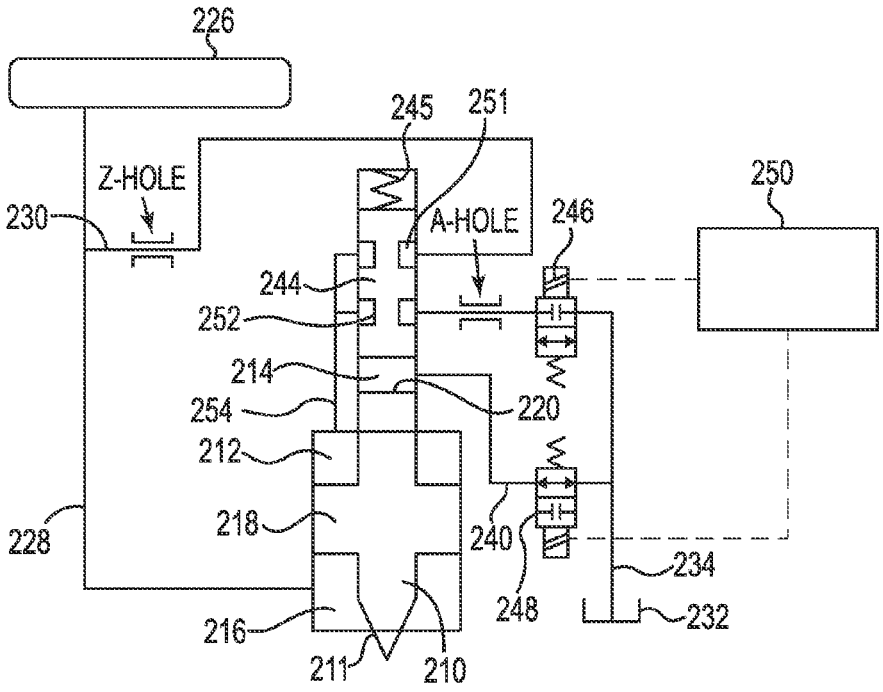
FIG. 6 is a schematic illustration of another DI injection system of the present invention also including a feedback circuit in accordance with the present invention, wherein an internal feedback spool and control holes of a control chamber are separated from a control chamber so that control chamber pressure can be controlled without fluid flow through the control chamber.

Yet another injector system in accordance with the present invention is schematically illustrated within FIG. 6. The injector needle 210 is movable within an injection chamber, which is shown as comprising a control chamber 212, a feedback chamber 214, and a delivery chamber 216. This injector is similar to that of FIG. 1 but with the feedback chamber 216 illustrated above the control chamber 212, meaning that the control chamber 212 is functionally intermediate to the delivery chamber 216 and the feedback chamber 216. The injector needle 210 comprises a control chamber plunger 218 and a feedback chamber plunger surface 220. A biasing means, such as a compression spring 245 is shown for biasing the needle 210 toward a closed position, for effectively closing the injector orifice 11, subject to fluid pressures within each of the chamber portions, as described in more detail below.

A common rail 226 is provided as a fuel supply at a desired operating pressure. As above, the design and provision of such common rails is well known, as is the operating pressures that are desired to be maintained within such a common rail depending of the type of fuel, for example, whether supplying gasoline or diesel fuel. The provision of fuel supply to the common rail at a desired pressure is also conventionally known.

From the common rail 226, a connecting pipe 228 runs to the delivery chamber 216 so that fuel can be supplied at the desired injection pressure into the delivery chamber 216 prior to injection. Branching from the connecting pipe 228, a pipe 230 also supplies the same pressurized fuel to the control chamber 212 by way of a Z hole, and IFS spool type valve 244, and a line 254. The common rail 226, connecting pipe 228 and branch pipe 230 (including passing through the IFS 244) comprise a high-pressure system of an embodiment of an injection control system of the present invention.

A low pressure system of the illustrated system of the present invention comprises a low pressure reservoir 232 that can be at a pressure as low as atmospheric, but preferably is controlled to be higher than atmospheric and potentially as high a pressure as up to the same pressure as the high pressure side within the common rail 226. Within the low pressure side, a first connecting pipe 234 provides fluid communication from the reservoir 232 to the feedback chamber 214 by way of a further line 240 and a feedback valve 248. The line 234 also provides fluid connection from the IFS 244 to the reservoir 232 by way of an A hole and a control valve 246.

As above, a feedback circuit can control the degree of movement of the injector needle 210 away from the injector orifice 211, as will be described below. This feedback circuit is shown as comprising the fluid connection line 240 from the pipe 234 and the feedback valve 248, the feedback chamber 214 and the IFS 244. The IFS 244 preferable comprises a conventional spool type valve having two annular grooves that together with an annulus of a housing within which the IFS 244 is slidably disposed create two openable and closable fluid passages 251 and 252 that are preferably opened and closed simultaneously and gradually in the same manner as described above based upon an axial shifting of the IFS 244 spool. The bias of spring 245 biases the IFS 244 to a position with both of the passages 251 and 252 open for reasons described below. When the IFS 244 is open, the A and Z holes are effectively open as well. When the IFS 244 is closed, the A and Z holes are effectively closed as well. In accordance with this embodiment of the present invention, fluid pressure within the control chamber 212 can be effectively regulated. Different from the embodiment of FIG. 1, opening the A and Z holes by opening the passages 252 and 251, respectively, regulates the pressure within the control chamber 212 by way of the line 254. Instead of fluid flow through the control chamber 212 to the low pressure side of the system, as in FIG. 1, fluid flow through the IFS 244 when the control valve 246 is activated to be open allows fluid flow through the low pressure side of the system and reduces the pressure within the control chamber 212 by way of reduced pressure within the line 254.

The control valve 246 is illustrated within the connection pipe 234 between the IFS 244 and the reservoir 232 with the A hole between the IFS 244 and the control valve 246. The control valve 246 can comprise an on/off solenoid valve that is preferably normally biased to a closed position, which would prevent flow from the passage 252 of the IFS 244 through the A-hole. At this point it can be seen that high pressure fuel as supplied by the common rail 226 would be provided through the Z hole, the passages 251 and 252 of the IFS 244, and the A hole as well as to the control chamber 212. When the control valve 246 is activated to open, such as at the initiation of an injection cycle, fluid flow is opened through the low pressure side allowing for a reduction in pressure to the control chamber by way of the line 254. In effect, the flow through the A and Z-holes as controllably allowed by opening the control valve 246 allows the pressure within the control chamber 212 to be regulated and reduced relative to the pressure within the delivery chamber, as the delivery chamber 216 is being supplied pressurized fuel from the common rail 226.

Also shown in FIG. 6, the feedback valve 248 selectively fluidly connects the low-pressure reservoir with the feedback chamber 214, which feedback valve 248 can also comprise an on/off solenoid type valve. The feedback valve 248 is preferably open when it is deactivated. However, when the feedback valve 248 is activated to be closed, fluid communication between the feedback chamber 214 and the low-pressure reservoir 232 is prevented while fluid pressure can build within the feedback chamber 214 based upon injector lifting so that the increased fluid pressure will act to shift the IFS 244 toward a position closing both the passages 251 and 252 gradually and simultaneously.

With the feedback valve 248 in its normal open position, the injector system can basically operate as a conventional direct injection system. Any pressurized fluid present or created by upward injector needle movement within the feedback chamber 214 will flow through the feedback valve 248 toward the low-pressure reservoir 232 without creating sufficient pressure to move the IFS 244 against its normal bias position allowing fluid flow through both passages 251 and 252. Thus, the high pressure system side will operate normally based upon the position of the control valve 246. Specifically with the control valve 246 closed, equal fluid pressure from the common rail 226 will be provided to both the control chamber 212 and the delivery chamber 216. In this state, the injector 210 will remain closed with the injector needle seated to the injector orifice 211. With the control valve 246 shifted to open, pressure within the control chamber 212 is reduced allowing fluid flow through both the A and Z-holes, This will eventually allow the pressure within the delivery chamber 216 to dominate the system to unseat the injector needle from the injector orifice 211 and thus open the orifice 211 for fuel delivery from the delivery chamber 216. The injector orifice 211 will open to the preset delivery position of the injector needle away from the orifice 211. As above, he present invention is directed to techniques for varying this process on a cycle-by-cycle basis for varying fuel injection rate for each cycle.

For injector operation according to the schematic of FIG. 6, the control valve 246 can be energized and opened to initiate an injection cycle. When the control valve 246 is open, high-pressure fluid flows though the Z hole, the passage 251, the passage 252, the A hole, the control valve 246 and through the line 234 to the reservoir 232. In this system state, the fluid flow creates a lower pressure within the control chamber 212. Thus, the injector needle 210 starts to move upward due to the higher pressure of the fuel as supplied to the closed delivery chamber 216. As such, when the feedback valve 248 is open, the injector system of FIG. 6 works as a conventional injector system.

On the controlled occurrence (preferably at least once for each injector delivery cycle) that the feedback valve 248 is activated and closed, the plunger surface portion 220 of the injector needle 210 will gradually reduce the feedback chamber 214 volume and increase the pressure of the fluid in the feedback chamber 214. As the fluid pressure force acting on the IFS spool 244 exceeds the spring preload of spring 245, the IFS 244 moves upward to gradually close the passages 251 and 252 to effectively stop fluid flow through the A and Z holes. Through this hydro-mechanical internal feedback mechanism, the closing speed of these two passages 251 an 252 and thus fluid flow though the control holes (the A and Z holes) is synchronous with injector needle displacement. Fluid pressure within the control chamber 212 can thereby be controllably regulated. Meanwhile, the needle upward motion raises the control chamber pressure 212. The increasing fluid pressure force in the control chamber 212 acting on the plunger portion 218 of the injector needle 210 will gradually decelerate the needle 210 to stop at a predetermined destination. By this design, the needle lift is determined robustly after the feedback valve 248 activation.

As the injector needle 210 stops moving as controllably limited by activation of the feedback valve 248, the tapered needle valve 210 is only opened partially from the injector orifice 211 so as to control a less than full injection flow rate from the delivery chamber 216 to an engine combustion chamber. Advantageously, the flow rate can be varied from cycle to cycle based upon activation timing of the feedback valve 248. When a full rate is subsequently desired, the feedback valve 248 can be deactivated after first achieving a partial-point stop and re-opened to allow draining of the fluid in the feedback chamber 214 to the low pressure reservoir 232. At this point also, the feedback chamber 214 begins to reassume a lower pressure condition. Then, the IFS 244 will be gradually released to its initial open position to gradually reopen the passages 251 and 252 and to allow fluid flow again through the A and Z control holes. The needle 210 would then be influenced again based upon the open control valve 246 (the flow of high pressure fluid through both the A and Z holes) to reduce the pressure within the control chamber 212 and thus to fully open the needle valve 210.

By adjusting the IFS 244 activation timing (the feedback valve closing timing), the injector needle 210 can be stopped at any assigned position within its full stroke. This provides the capability to shape the injection rate continuously. For example, at the partial lift position as defined by closing the feedback valve 248 at a desired time, fuel will flow from the injector orifice 211 as controlled by the position of the tapered surface of the injector needle 210 to the injection orifice 211. This can occur for a determined time. Then by deactivating the feedback valve 248 after the determined period while the control valve 246 is still activated, the fuel flow rate can be controllably increased to a full flow rate by the change in orifice area that is opened by further movement of the injector needle 210 away from the injection orifice 211. Again, this full flow rate injection period can be determined as well. It is also contemplated that there could be more than one partial-point stops during a single injection cycle. In any case, timing of the activations and deactivations of the feedback valve 248 along with the timing of activation and deactivation of the control valve 246 can be controllably changed on a cycle-by-cycle basis under the control of an electronic control module 250. A control module 250 is schematically illustrated as electronically connected with both the control valve 246 and the feedback valve 248 via the dashed connection lines in FIG. 6. As above, it is understood that the control module 250 can be conventionally provided with control circuitry to control the activation and deactivation timing of both the control valve 246 and the feedback valve 248, based upon the known ability to control a control valve under known DI control systems. Similar timing control circuitry can be used for each of the activation and deactivation steps of both valves. Control modules usable in accordance with the present invention are well known and commercially available. In accordance with the present invention, controlled programming of the feedback circuit and thus valve activation can be done in the same manner as a conventional control valve of prior art systems are controllable activated.

Figure 7:
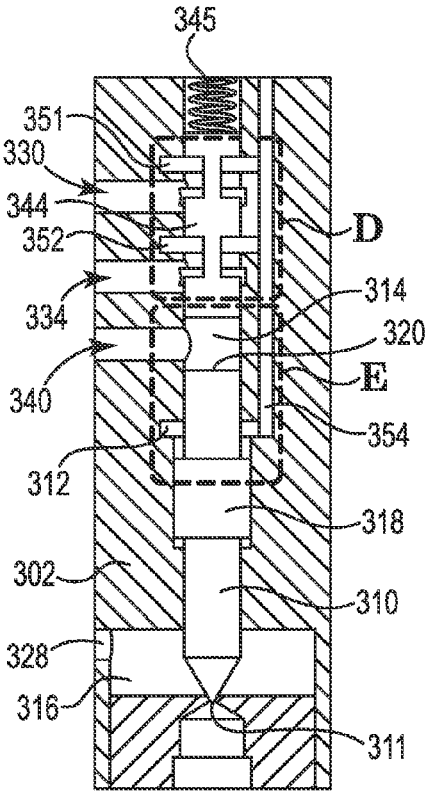
FIG. 7 is a cross sectional view of an injector in accordance with the present invention that can be utilized within the system of FIG. 6.
Figure 8:
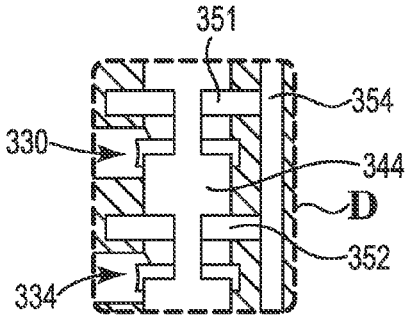
FIG. 8 is an enlarged view of the portion of the injector of FIG. 6 within the area of dashed rectangle D and in accordance with the present invention.
Figure 9:
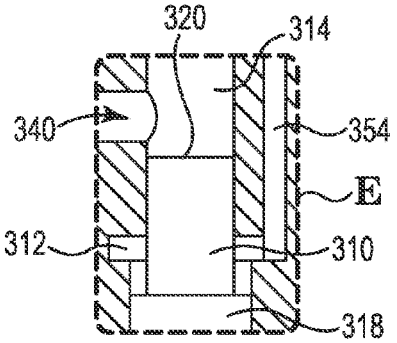
FIG. 9 is an enlarged view of the portion of the injector of FIG. 6 within the area of dashed rectangle E and in accordance with the present invention.
Figure 10:
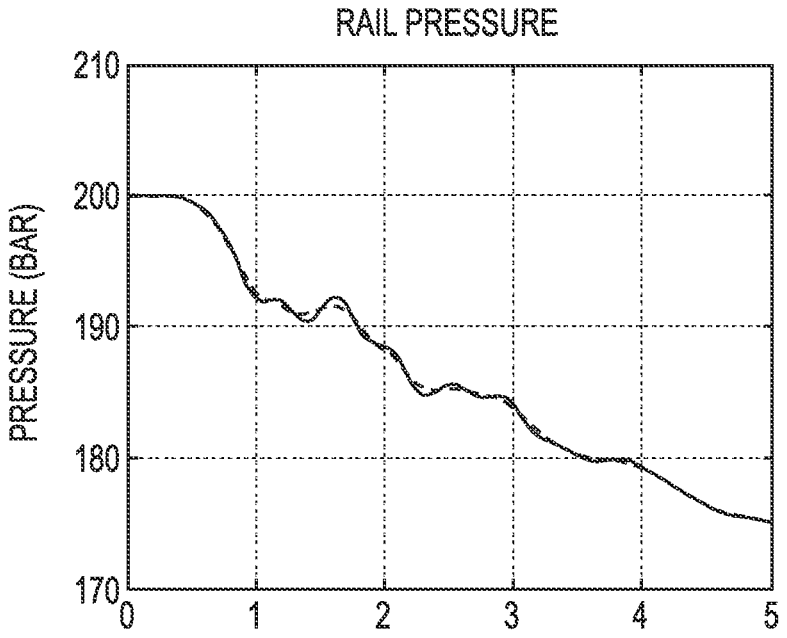
FIGS. 10-13 are graphical illustrations of observations related to the estimation of injection flow rate based upon the activation of an internal feedback spool at a determined time after the start of injection.
Figure 11:
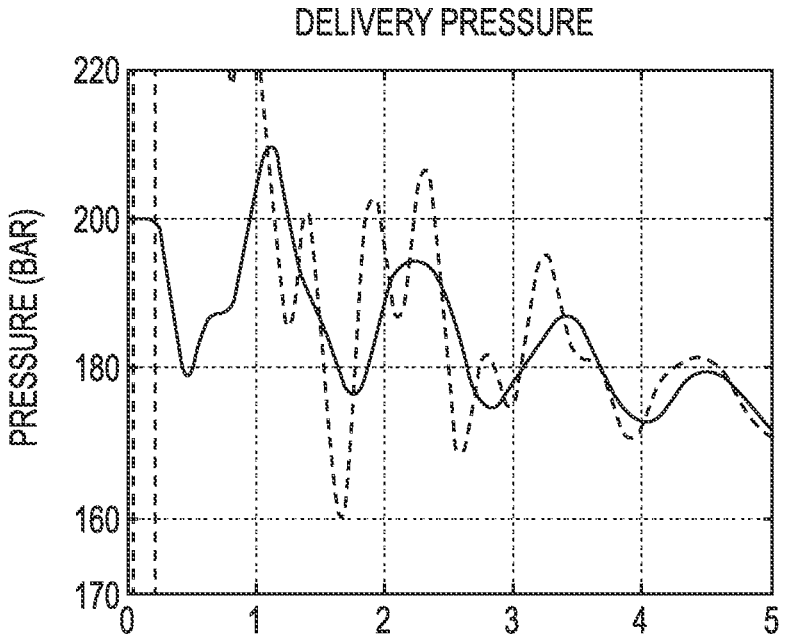
Figure 12:
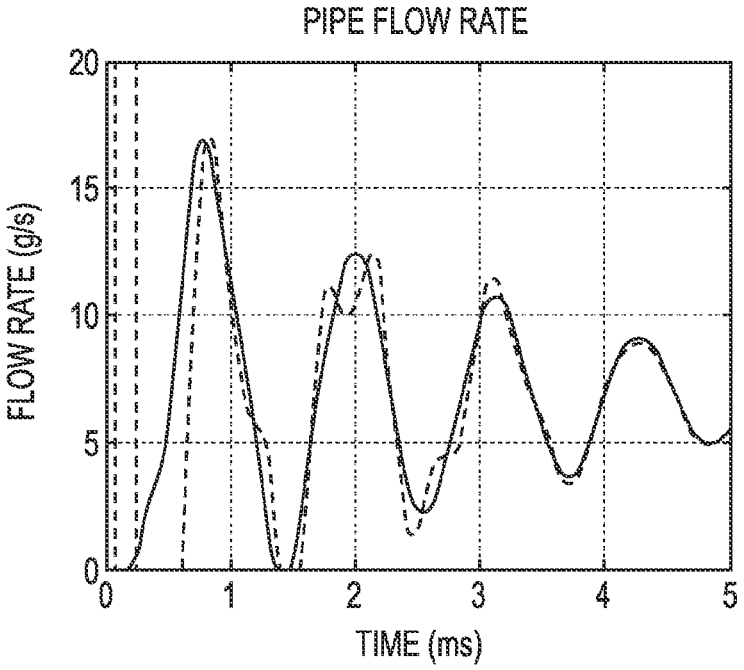
Figure 13:
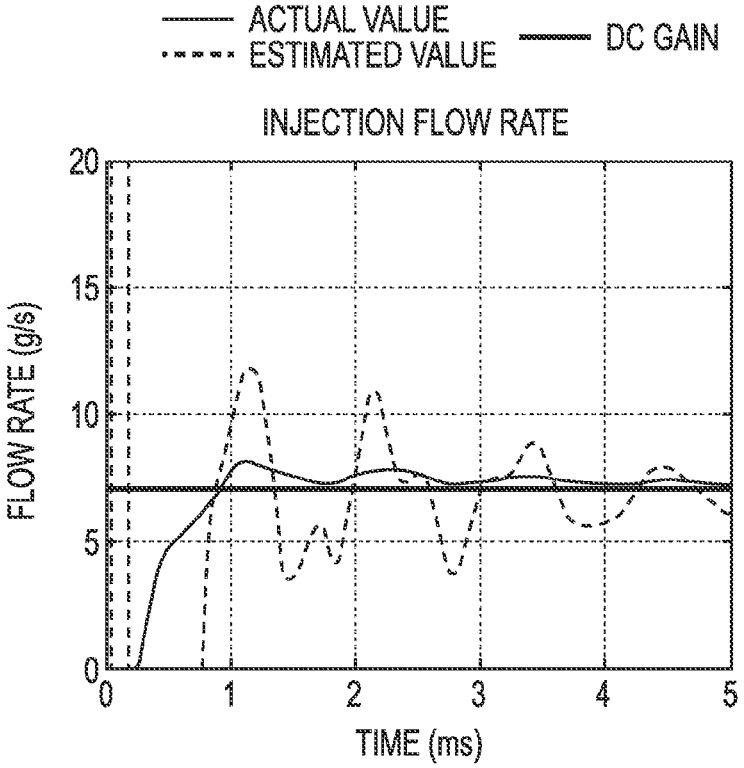

In FIGS. 7-9, an injector design is illustrated in accordance with the present invention and based upon the system of FIG. 6. It is understood that the high and low pressure sides of the system of FIG. 6 could be as schematically illustrated to work with the injector design of FIGS. 7-9. Moreover control of the operation including the feedback circuit can be accomplished in the same manner as that described above with respect to FIG. 6. Similar components are labeled similarly in FIGS. 7-9 but with a 3 in the hundred position instead of a 2.

An injector 310 is illustrated as slidingly disposed within a central bore of a housing 302. The central bore preferably comprises a bore suitable for the injector 310 to slide within a range determined by an injection stroke taking into account the injector components including the injector needle, a control chamber plunger 318, a spool type IFS 344 including multiple annular grooves, a delivery chamber 316, a control chamber 312, and a feedback chamber 314. The housing 302 preferably defines the central bore within which the injector 310 is slidably guided and also preferably includes multiple annulus type grooves that correspond in position and axial spacing with the annular recesses or grooves of the spool of the IFS 344. Together the annuluses of the housing and the recesses or grooves of the spool of the IFS create the passages 351 and 352, which passages are controllable opened and closed gradually and simultaneously by an axial shifting movement of the spool of the IFS 344 under control of the system including a control valve 246 and feedback valve 248 as above.

Furthermore, the housing preferably is provided with a number of ports that function as follows and correspond to fluid flow path portions of the system of FIG. 6, as above. A port 330 corresponds to the line 230 that would connect the passage 350 with the common rail 226 by way of a Z hole. The Z hole can be designed into the housing port 330 or otherwise be provided anywhere functionally between the common rail 226 and the port 330. A port 334 corresponds to the line 234 connecting between the reservoir 232 and the passage 252 (passage 352 of the FIGS. 7-9 embodiment) by way of the control valve 246. Port 340 functions as the line 240 for connecting the reservoir with the feedback chamber 314 by way of a feedback valve 240. A port 328 functions as and corresponds to the line 228 for providing high pressure fuel to the delivery chamber 316.

A second axial passage 354 is shown through the housing 301 from the top and open to both of the passages 350 and 352 that are controlled open and closed by the IFS 344. This passage 354 corresponds to the line 254 of FIG. 6 allowing fluid communication between the control chamber 212 and the passages 251 and 252 for regulating pressure. In the case of FIG. 7, the passage 354 extends to also connect with the control chamber 312 so that the pressure within the control chamber 312 can be regulated by the opening and closing of the control valve 246 and the feedback valve 248 in the manner as described above.

To provide a wide range of injection flow rate variation, designs of the present invention can have the ability to keep needle lift as low as possible. In other words, the IFS valves or sleeve or the like can close the A, Z holes rapidly. Hence, the feedback area (the surface area of the feedback plunger 20 or 120 that increases the pressure within the feedback chamber 14 or 114) needs to be designed appropriately relative to the IFS area (bottom surface of the IFS spools of the valves 44 or the surface area of IFS control surface 147).

Since the injection rate can be varied within one injection in this design, the multiple-injection strategy is unnecessary. As a result, the response requirement for the injector actuator becomes lower.

Injection flow rate estimation and control of fuel injection systems of the present invention also comprises an aspect of the present invention. An example of an estimator for flow rate is described below, which flow rate information can be used within an iterative learning controller in accordance with the present invention as also described below. By utilizing flow rate estimation along with an iterative learning controller, timing of the hydraulic control and feed back valves of the present invention can be controlled and adjusted on a cycle by cycle basis in order to achieve desired fuel flow rates.

As described above, fuel injection systems of the present invention can deliver fuel at flexible injection flow rates. In designs of the present invention, once an IFS spool, sleeve, or the like is activated, an injector needle lift can be determined robustly without any real-time feedback control. Thus, by setting a period between a start of injection (SOI) signal and an IFS activation timing ($T_{ifs}$), needle lift and the injection flow rate are given. Therefore, the injection rate shaping control is achieved by adjusting the $T_{ifs}$.

However, before IFS activation, needle lift is open-loop controlled and could be affected by many factors, such as needle friction, pressure within the injector chambers, or the control valve 46 or 246 opening timing. All of these factors influence the exact timing for the IFS activation, but these factors are difficult if not impossible to be monitored in real time. Therefore, calibration based on feed-forward control cannot effectively overcome the problem, and a feedback control of injection flow rate is required.

Furthermore, since the assembly space for an injector is so limited, it is extremely difficult to install any displacement sensors or flow-meters within the space of the injector. The inability to provide such sensors impedes feedback control realization.

In the injector systems of the present invention, tracking error of injection flow rate can be discrete from one injection cycle to the others during the IFS activation. The activation timing of an IFS valve (including the provision and use of more than one IFS valve, sleeves, other spool valves, or the like, collectively an IFS valve) is a feedback control input that can also be discrete from cycle to cycle. An iterative learning control (ILC) has been developed in accordance with an aspect of the present invention to solve this problem. The iterative learning control is designed as a proportion controller that feedbacks the injection rate error of the current injection cycle to adjust the IFS activation timing of next injection cycle. The control equation is expressed as:

$$T_{ifs}(n+1)=T_{ifs}(n)+K[q_{inj_{des}}(n)-q_{inj_{actual}}(n)] \quad \text{(Equation 1)}$$

Where the n means the $n^{th}$ cycle, and the $q_{inj_{des}}$ and $q_{inj_{actual}}$ are the desired and actual volumetric injection flow rate, respectively. With an appropriate gain K, the injection rate tracking error could be eliminated in finite cycles, and the tracking performance can be guaranteed.

The feedback of the injection flow rate is an important value to make the iterative learning control of this example work. From an injector design, once the IFS completely closes the A and Z holes, the injector needle becomes static, and there is no fuel flowing in and out the control chamber. It has been determined that injector needle displacement and the injection flow rate tend to be constant after the IFS closing of the control chamber A and Z control orifices.

During the IFS activation period, the whole system can be simplified as a fourth-order dynamic model with following assumptions.

The volumetric flow rate is identical in the connecting pipe between the common rail and the injector delivery chamber.

The injection flow rate $q_{inj}$ is a constant.

The wall friction effect of the connecting pipe is neglected.

$$\dot{x}_1 = \frac{\beta}{V_r}(Q_p - x_3) \quad \text{(Equation 2)}$$

$$\dot{x}_2 = \frac{\beta}{V_d}(x_3 - x_4)$$

$$\dot{x}_3 = \frac{A}{l * \rho}(x_2 - x_3)$$

$$\dot{x}_4 = 0$$

$$y = [1 \quad 0 \quad 0 \quad 0]X$$

Where the $x_1$, $x_2$ are the pressure in the common rail and in the injector delivery chamber, the $x_3$ is the volumetric connecting pipe flow rate, and the $x_4$ is the $q_{inj}$. The l, A are the length and the cross-section area of the connecting pipe. The $Q_p$ is the pump flow rate and is treated as the system input that can be calculated by the engine speed and the crank angle. The equation 2, just above, is mathematically observable, and the states that an observer is designed by the general linear observer design technique.

To demonstrate the effect of the observer, the condition that the IFS is activated at 0.1 ms after the SOI is discussed below based upon the equation above. The results are shown in FIGS. 10-13. In this example, the IFS closes the orifices of the injector control chamber at about 1 ms, and the injector needle also stops lifting at the same time. When the needle stops lifting, it causes a water hammer effect in the hydraulic circuit of the CRDI system so that the pipeline flow rate and the delivery chamber pressure start to vibrate. The vibration of the injection flow rate is dampened via the injector nozzle orifice. Because it is simplified from an actual system model, modeling errors cause that the estimation values of the injection flow rate and the delivery chamber pressure converges lower to the actual ones. The error of the injection flow rate estimation varies periodically but decays exponentially. Since there is no real-time feedback control involved, a post process is preferably applied to find the correct estimation value of the injection flow rate. By applying a discrete Fourier transform on the estimation value of the injection flow rate, the DC gain of the estimated injection flow rate can be calculated. In FIGS. 10-13, it is illustrated that the actual injection flow rate gets close to the DC gain when the injection rate vibration is reduced.

Figure 14:
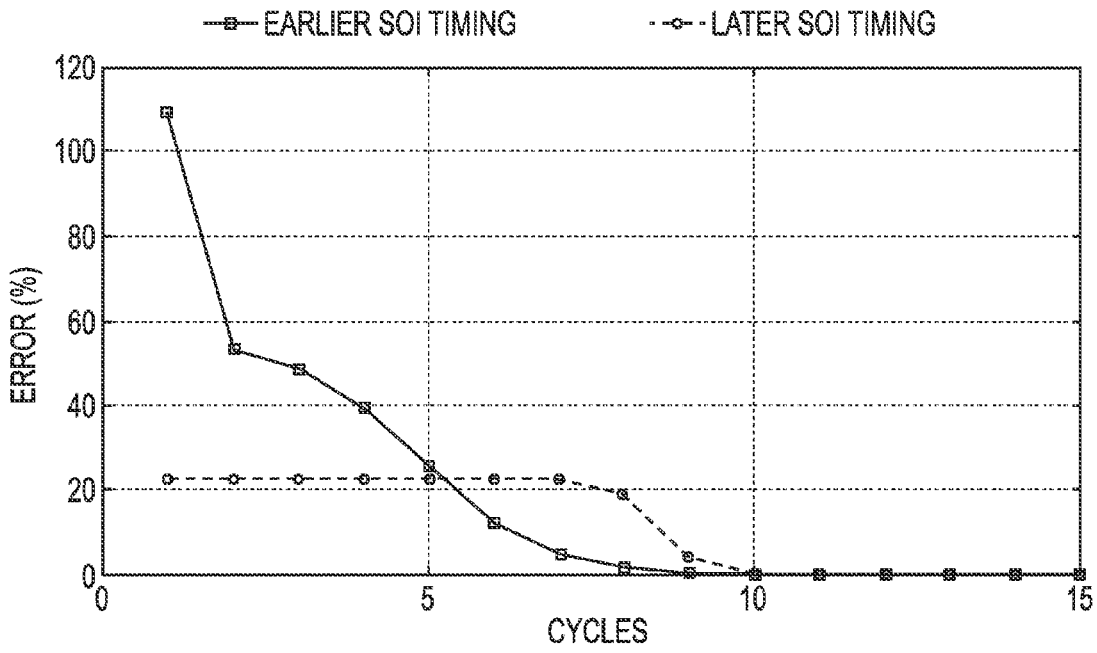
FIG. 14 is a graphical illustration of plural examples with timing changes of the time period of activation of an internal feedback spool and start of injection and tracking the ability to correct error within a number of injection cycles based upon an iterative learning control of the present invention.

By using the DC gain as the feedback in (Equation 1), the $T_{ifs}$ can be adjusted to eliminate the injection flow rate error preferably according to a pre-calibration DC gain map. Two cases are used to demonstrate the effect of the iterative learning control. For example, in order to simulate the uncertainty of the needle lift, the SOI signal can be intentionally set 0.1 ms earlier, for one example, and the SOI signal can be set 0.1 ms later than, for another example, than they should be in the normal case where the SOI is at 1 ms and $T_{ifs}$ is at 1.1 ms. According to these examples, the ILC adjusts the $T_{ifs}$ to correct the injection flow rate to the desired one, and the error of injection flow rate occurred at beginning decreases after several cycles, as shown in FIG. 14. Also within FIG. 14, for the later SOI example, the $T_{ifs}$ is activated before the SOI at beginning. Although the iterative learning controller works for every cycle, the $T_{ifs}$ is still earlier than the SOI until the eighth cycle, which causes the same errors for the first seven cycles. A more aggressive feedback gain would shorten the learning time.

According to the above described aspects of the present invention, a novel DI injector is designed to deliver continuously variable fuel injection flow rate, and an injection controller can be designed to track the desired flow rate. With a hydro-mechanical feedback mechanism of the present invention, injector needle lift can be controlled by adjusting the activation timing of the feedback on/off valve. The injection needle valve opening can vary according to the needle lift, and then the variable injection rate shaping can be achieved in one injection shot. Comparing to the multiple-injection method, this design is beneficial not only for lowering the actuator requirement but also for eliminating the injection quantity inconsistency. When an IFS valve, sleeve, spool or other of the present invention completely closes the A and Z control holes that affect pressure within the injector control chamber, the injector needle becomes static, and then the injection flow rate converges to a constant. An injection flow rate estimator can also be designed without the use of sensors for measuring the flow rate or needle position directly. An iterative learning control can also be designed to track the desired injection rate.

What is claimed is:

1. A fuel injector for use within a direct injection fuel injection system having a common rail for supplying fuel at a determined delivery pressure, the fuel injector comprising:

an injector needle slidably disposed within a housing, the injector needle and the housing together providing a control chamber wherein the control chamber is fluidly connected with both a first control orifice within a connection with pressurized fuel from the common rail and a second control orifice within a connection with a drain line so that fluid pressure can be regulated within the control chamber by way of control of fluid flow through the first and second control orifices, a delivery chamber including a port for connection with the pressurized fuel from the common rail and an injection orifice from which fuel can be injected upon movement of the injector needle, and a feedback chamber being in fluid communication with at least one internal feedback spool valve that can be actuated by increased pressure within the feedback chamber to close the first and second control orifices of the control chamber based upon movement of the injector needle.

2. The fuel injector of claim 1, wherein a single internal feedback spool valve closes both the first and second control orifices of the control chamber simultaneously.

3. The fuel injector of claim 2, wherein the internal feedback spool valve comprises a sleeve slidable along a portion of the injector needle including a surface of the sleeve that is in fluid communication with the feedback chamber so that increased pressure within the feedback chamber can act on the sleeve surface.

4. The fuel injector of claim 3, further comprising a biasing element for urging the sleeve away from a position closing the first and second control orifices of the control chamber.

5. The fuel injector of claim 1, wherein a plurality of internal feedback spool valves are provided with one for closing the first control orifice of the control chamber and another one for closing the second control orifice of the control chamber, both under the influence of increased pressure within the feedback chamber in a similar manner.

6. The fuel injector of claim 2, wherein the internal feedback spool comprises a spool valve with plural axial spaced connection recesses for selectively opening and closing a first fluid passage and a second fluid passage simultaneously based upon an axial position of the internal feedback spool as influenced by pressure within the feedback chamber.

7. The fuel injector of claim 6, wherein the first control orifice is fluidly located between the common rail and the first passage of the internal feedback spool, and the second control orifice is fluidly located between the second passage and the drain.

8. The fuel injector of claim 7, further in combination with a control valve that is fluidly located between the second passage and the drain.

9. The fuel injector of claim 8, further in combination with a feedback valve that is located fluidly between the feedback chamber and the drain.

10. The fuel injector of claim 1, further in combination with a control valve that is fluidly located between the first control orifice and the drain.

11. The fuel injector of claim 1, further in combination with a feedback valve that is located fluidly between the feedback chamber and the drain.

12. A direct fuel injection system for connection with a common rail for supplying fuel at a determined delivery pressure, the fuel injection system comprising:

a fuel injector including an injector needle slidably disposed within a housing, the injector needle and the housing together providing a control chamber wherein the control chamber is fluidly connected with both a first control orifice within a connection with pressurized fuel from the common rail and a second control orifice within a connection with a drain line so that fluid pressure can be regulated within the control chamber by way of control of fluid flow through the first and second control orifices, a delivery chamber including a port for connection with the pressurized fuel from the common rail and an injection orifice from which fuel can be injected upon movement of the injector needle, and a feedback chamber being in fluid communication with at least one internal feedback spool valve that can be actuated by increased pressure within the feedback chamber to close the first and second control orifices of the control chamber based upon movement of the injector needle;

a control valve fluidly within the drain line from the control chamber capable of selectively opening and closing the drain line to regulate fluid pressure within the control chamber;

a feedback valve provided within a fluid line connected with the feedback chamber capable of selectively opening and closing the fluid line from the feedback chamber and for selectively controlling activation of the at least one internal feedback spool valve; and a control module for selectively activating the control valve and the feedback valve during a fuel injection cycle, wherein the control valve and the feedback valve can be varied on a cycle-by-cycle basis.

13. The direct fuel injection system of claim 12, wherein the control valve is biased toward a closed position.

14. The direct fuel injection system of claim 12, wherein the feedback valve is biased toward an open position.

15. The direct fuel injection system of claim 12, wherein a single internal feedback spool valve closes both the first and second control orifices of the control chamber simultaneously.

16. The direct fuel injection system of claim 15, wherein the internal feedback spool valve comprises a sleeve slidable along a portion of the injector needle including a surface of the sleeve that is in fluid communication with the feedback chamber so that increased pressure within the feedback chamber can act on the sleeve surface.

17. The direct fuel injection system of claim 16, further comprising a biasing element for urging the sleeve away from a position closing the first and second control orifices of the control chamber.

18. The direct fuel injection system of claim 12, wherein a plurality of internal feedback spool valves are provided with one for closing the first control orifice of the control chamber and another one for closing the second control orifice of the control chamber, both under the influence of increased pressure within the feedback chamber in a similar manner.

19. The fuel injector of claim 12, wherein the internal feedback spool comprises a spool valve with plural axial spaced connection recesses for selectively opening and closing a first fluid passage and a second fluid passage simultaneously based upon an axial position of the internal feedback spool as influenced by pressure within the feedback chamber.

20. The fuel injector of claim 12, wherein the first control orifice is fluidly located between the common rail and the first passage of the internal feedback spool, and the second control orifice is fluidly located between the second passage and the drain.

21. A method of flow rate estimation and iterative learning control for timing of activation of a control valve and a feed back valve so that the feedback valve can be controlled and adjusted on a cycle by cycle basis in order to achieve a desired fuel flow rates from an injector of a direct fuel injection system, the injector comprising an injector needle slidably disposed within a housing, the injector needle and the housing together providing a control chamber wherein the control chamber is fluidly connected with both a first control orifice within a connection with pressurized fuel from the common rail and a second control orifice within a connection with a drain line so that fluid pressure can be regulated within the control chamber by way of control of fluid flow through the first and second control orifices, a delivery chamber including a port for connection with the pressurized fuel from the common rail and an injection orifice from which fuel can be injected upon movement of the injector needle, and a feedback chamber being in fluid communication with at least one internal feedback spool valve that can be actuated by increased pressure within the feedback chamber to close the first and second control orifices of the control chamber based upon movement of the injector needle, the method comprising the steps of:

estimating the flow rate of the injector based on the measurement of the common rail pressure, the activation timing of the control valve and the activation timing of the feedback valve; and iteratively controlling the period between activation timing of the control valve and the feedback valve on an injection cycle by cycle basis by way of an iterative learning control of a control module that is electronically connected with the control valve and the feedback valve for controlled activation of the control valve and the feedback valve.

22. The method of claim 21, wherein the step of iteratively controlling the period between the activation timing of the control valve and the activation of the feedback valve comprising utilizing a control equation as applied on a cycle by cycle basis, the control equation is expressed as:

$$T_{ifs}(n+1)=T_{ifs}(n)+K[q_{inj_{des}}(n)-q_{inj_{actual}}(n)]$$

where the n means the $n^{th}$ cycle, and the $q_{inj_{des}}$ an $q_{inj_{actual}}$ are the desired and actual volumetric injection flow rate, respectively and with an appropriate gain K.

* * * * *